United States Patent [19]

Hand

[11] Patent Number: 4,844,416

[45] Date of Patent: Jul. 4, 1989

[54] CROWBAR

[76] Inventor: Patrick Hand, Rt. 632, P.O. Box 31, Asbury, N.J. 08802

[21] Appl. No.: 93,614

[22] Filed: Sep. 8, 1987

[51] Int. Cl.[4] ..... B66F 15/00

[52] U.S. Cl. ..... 254/25

[58] Field of Search ..... 254/25, 131, 26 R, 21, 254/26 E, 28; 29/275, 254; 7/12

[56] References Cited

U.S. PATENT DOCUMENTS

| | | | |
|---|---|---|---|
| 815,064 | 3/1906 | Campbell | 254/25 |
| 940,197 | 11/1909 | Scarbrough | 254/25 |
| 1,221,323 | 4/1917 | Hill | 254/25 |
| 1,715,826 | 6/1929 | Fielding | 254/28 |
| 3,134,574 | 5/1964 | Reuterfors | 254/25 |

*Primary Examiner*—Robert C. Watson

*Attorney, Agent, or Firm*—Thomas L. Adams

[57] ABSTRACT

A crowbar includes a lower portion, a middle portion, and an upper portion. The lower portion has a tip portion with a bearing surface. The middle portion is an offset portion. The upper portion has a plum line surface, which is disposed at an angle of about 90 degrees to the tip portion/bearing surface. The crowbar is useful in removing material from poorly accessible regions such as ceilings or floor - wall corners. For example, the crowbar can readily remove baseboards of partition walls, and wood lath from ceiling beams and is useful in lifting heavy objects and the like.

10 Claims, 1 Drawing Sheet

FIG. 1
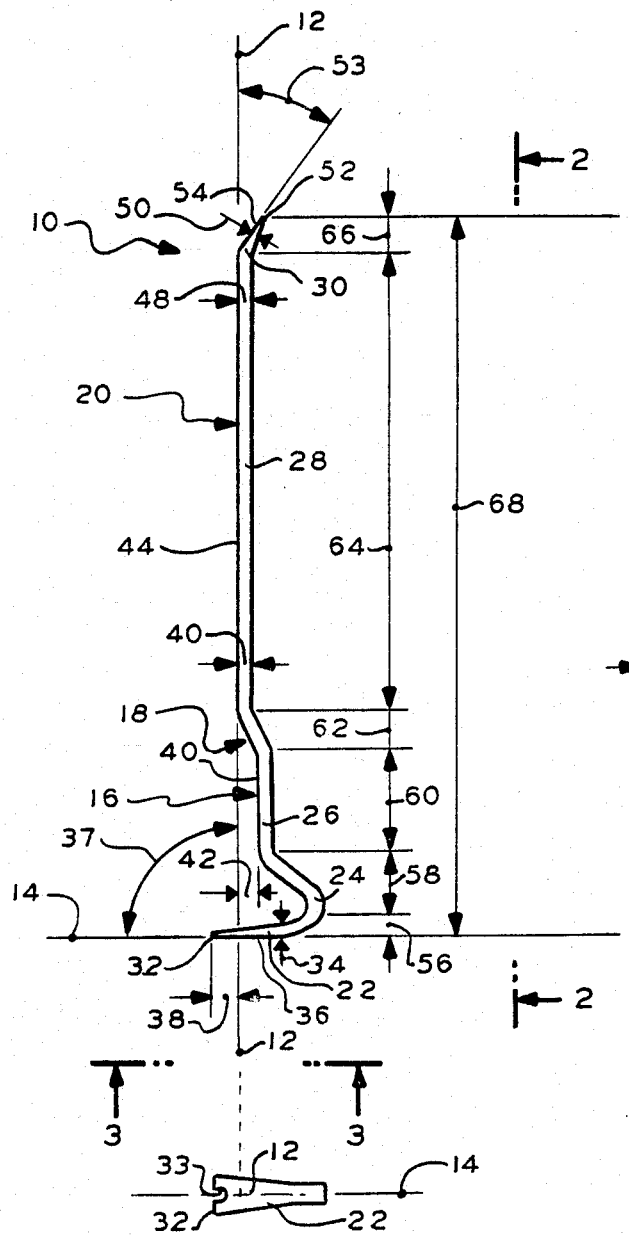
FIG. 2
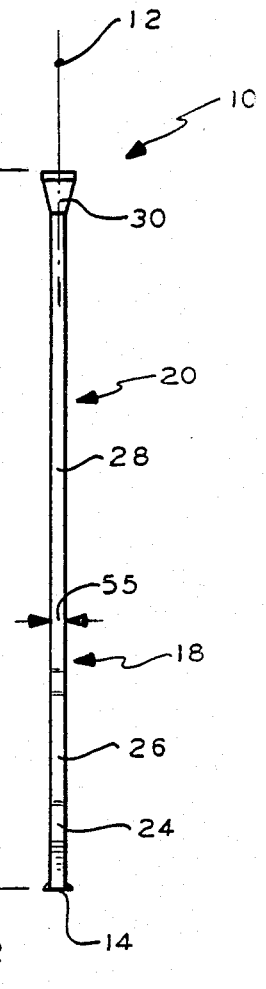
FIG. 3

CROWBAR

BACKGROUND OF THE INVENTION

The invention relates to a crowbar and particularly relates to a crowbar having a vertical plumb line surface and a bearing surface normal thereto. Prior art tools are described in U.S. Pat. Nos. D45,821; 815,064; 2,330,092; and 3,769,644. U.S. Pat. No. 815,064 describes a demolition crowbar, which includes a lower portion having a tip portion with a bearing surface, a middle offset portion, and an upper portion having a plumb line surface, which is disposed at an angle of about 45 degrees to a plane through the tip bearing surface.

A problem with the prior art crowbar is that it is not easily used overhead. The acute angle at its tip requires placing the main length of the bar close to the surface being worked at an acute angle. Thus the user must reach close to the ceiling. Also this known crowbar is not usable for removing baseboards of building partition walls or for lifting objects. The acutely bent up of the known bar must be inserted into a corner under a baseboard or under an object usually having a vertical face. Because of the acutely bent tip, the main length of the known bar interferes with the wall or the object. Other problems with the prior art crowbar are that it is not usable for easily removing wood lath from building ceilings, or usable for lifting a crate end from the ground.

Accordingly, there is a need for an improved crowbar that can be easily used for prying overhead or into corners or for lifting heavy objects.

SUMMARY OF THE INVENTION

According to the present invention, a crowbar is provided. The crowbar comprises a lower portion having a tip portion with a bearing surface, a middle offset portion, and an upper portion having a plumb line surface, which is disposed at an angle of about 90 degrees to the tip bearing surface.

By using the tip portion structure with a bearing surface disposed at an angle of about 90 degrees to the plum line surface, the aformentioned problems are avoided.

By using crowbars of the foregoing type, a more convenient and practical tool is achieved for removing or lifting objects from poorly accessible sites. The above tool facilitates removing such objects as baseboards from partition walls, wood lath from ceiling beams and similar tasks. These tasks could not be readily performed with known crowbars having the conventional, acutely bent tip.

In a preferred embodiment the crowbar ends in a "question mark" shape. This shape allows a prying force parallel to the main length of the bar. Accordingly, the present invention makes it possible to pry a baseboard in a direction parallel to a wall, with the length of the crowbar vertical and non-interfering. The unique shape of the preferred crowbar, with its three portions, provides an offset that gives additional clearance around the point of contact with the object to be pryed or lifted. Because the preferred crowbar has an offset, it is more readily placed into difficult positions.

The above advantages and subsequent description will be more readily understood by reference to the following drawings.

BRIEF DESCRIPTION OF THE DRAWINGS

The above brief description as well as other objects features and advantages of the present invention will be more fully appreciated by reference to the detailed description of presently preferred but nonetheless illustrative embodiments in accordance with the present invention when taken in conjunction with the accompanying drawings, wherein:

FIG. 1 is an elevation view of a crowbar according to the present invention;

FIG. 2 is a section view as taken along the line 2—2 of FIG. 2-2 of FIG. 1; and FIG. 3 is a bottom view as taken along the line 3—3 of FIG. 1.

DESCRIPTION OF THE PREFERRED EMBODIMENTS

Referring to FIG. 1, 2 and 3, a crowbar 10 according to the present invention is provided. The disclosed crowbar is a machined steel casting, although other materials and manufacturing methods are contemplated. Crowbar 10 includes a reference vertical plumb line or axis 12 and a reference horizontal line or axis 14, which is disposed normal to line 12.

Crowbar 10 includes a lower portion 16, a middle offset portion 18, and an upper portion 20.

Lower portion 16 includes a pointed end portion 22, a reverse bend portion 24 and a straignt portion 26.

Middle portion 18 is an offset portion. Upper portion 20 includes a straight portion 28 and a pointed end portion 30. Portions 28 and 26 may be round stock or, preferably, stock having an octagonal or other polygonal cross section.

End portion 22 has a tip portion 32, and a slot 33, and a tapered thickness 34. End 22 has a bearing surface 36 at an angle 37 of about 90 degrees to line 12. Tip portion 32 is offset by a distance 38 from plumb line 12.

Straight lower portion 26 has a surface 40, which is offset a distance 42 from plumb line 12. Straight upper portion 28 has a surface 44, which includes plumb line 12. Straight upper portion 28 has a lower thickness 46, and an upper thickness 48, which is equal to thickness 46 in this embodiment.

Pointed end portion 30 has a tapered thickness 50. End portion 30 has a tip portion 52. End 30 has a bearing surface 54, which is disposed at an angle 53 of about 45 degrees to line 12 and surface 44. In FIG. 2, crowbar has a thickness 55, which is approximately equal to thickness 46.

In FIG. 3, end portion 22 and slot 33, are disposed symmetrical about line 14, which passes through line 12. Slot 33 can be used to pull nails, as required.

In order to facilitate an understanding of the principles associated with the foregoing tool, its operation will now be briefly described. In operation or use, in order to remove a baseboard (not shown) from a partition wall (not shown), crowbar 10 is positioned, so that surface 44 is parallel approximately to the face of the wall, and bearing surface 36 rests on the floor surface under the baseboard. By applying a pulling force, normal to straight upper portion 28, a drive force can be applied by pointed end portion 22 in an upward direction against the underside of the baseboard, in order to remove the baseboard from the wall.

Significantly, offset 42 places portion 26 further away from the wall and baseboard. Thus there is more clearance and the tip 32 can be inserted further under the baseboard. Also because portion 28 is not offset, the bar 10 can be pulled further before meeting any other obstruction.

In order to remove a wood lath or wood lath member (neither shown) in a ceiling (not shown), tip portion 22 is inserted between an upper face of the lath and a ceiling beam (not shown) which supports the lath. The straight portion 28 would then extend vertically downwardly from the ceiling. Being vertical, the user does not have to work on a platform when doing ceiling work. By applying a normal force on straight portion 28, a drive force can be applied by pointed end portion 22 in a downward direction against the wood lath, in order to remove the wood lath from the ceiling.

In order to lift an end of a crate (not shown) or any other heavy object, tip portion 22 is inserted between an underside of a crate and a ground surface. The crowbar surface 44 is then approximately parallel to a side face of the crate, and the crowbar bearing surface 36 rests on the ground surface, drive force can be applied against the underside of the crate, in order to lift an end of the crate. As before the vertical placement of prior 28 and the clearance given by offset 42, make crowbar 10 well adapted to this lifting task.

In this embodiment, the projected height dimensions in FIG. 1 have the values as indicated hereafter. End portion 22 has a height 56 of about 2 inches. Bend portion 24 has a height 58 of about 3 inches. Bend portion 24 has a height 60 of about 3 inches. Straight portion 26 has a height 60 of about 7 inches. Middle offset portion 18 has a height 62 of about 2 inches. Straight upper portion 28 has a height 64 of about 20 inches. Crowbar 10 has an overall projected height 68 of about 36 inches.

In this embodiment, offset distance 38 is about one and one half inches, and offset distance 42 is about one inch. Middle portion 18 and lower portions 24, 26 each is equal in thickness to thickness 46. Tapered about thickness 34 maintains about the same cross sectional area over the length thereof. Tapered thickness 50 also maintains about the same cross sectional area over the length thereof. A upper end 30 flares out, as shown in FIG. 2. Lower end 22 flares out, as shown in FIG. 3. It will be appreciated that the above dimensions can be varied depending upon the size of the task and the forces needed.

While the invention has been described in its preferred embodiments, it is to be understood that the words which have been used are words of description rather than limitation and that changes may be made within the preview of the appended claims without departing from the true scope and spirit of the invention in its broader aspects.

In an alternate construction of crowbar 10, upper straight portion 28 could tapered down from thickness 46 to thickness 48, as a force applied normal to portion 28 causes a larger bending moment at thickness 46 than at thickness 48.

In an alternate construction of crowbar 10, a cross section view through upper portion 28 could be a square section having an edge thereof, including plumb line 12. Then, surface 44 would be the surface of such edge only. A diamond shaped section view could also be used having an edge, including plumb line 12.

The embodiments of an invention in which an exclusive property or right is claimed are defined as follows:

1. A crowbar comprising:

an upper portion containing a longitudinal reference axis;

a middle offset portion connected to said upper portion and having a shifted end distal to said upper portion, said shifted end being displaced from said longitudinal reference axis in an outwardly transverse direction by a predetermined distance; and a lower portion connected to said shifted end and including:

(a) a pointed end distal to said middle offset portion;

(b) a bearing surface coterminous with said pointed end and transverse and distal to said upper portion;

(c) an extension connected to said shifted end and substantially parallel to and spaced from said longitudinal reference axis for providing clearance behind and above said pointed end; and (d) a concave interval between said extension and said bearing surface having a C-shaped centerline, said concave interval having a crest displaced from said longitudinal reference axis in said outwardly transverse direction, said bearing surface being disposed at an angle of about 90 degrees to said longitudinal reference axis.

2. The crowbar of claim 1 wherein said middle offset portion has a surface which is offset a specified distance from the longitudinal reference axis.

3. The crowbar of claim 1, wherein said lower portion having said pointed end portion has a tapered thickness and a tip portion and a slot; and wherein said lower portion has a reverse bend portion and has a straight portion; and wherein said pointed end portion and the reverse bend portion and the straight portion together have a "question mark" shape.

4. The crowbar of claim 1, wherein said upper portion includes a straight portion, and pointed end portion which has a surface that is disposed at an angle of about 45 degrees from the longitudinal reference axis.

5. The crowbar of claim 4, wherein said upper portion having a straight portion has a lower thickness and has an upper thickness.

6. The crowbar of claim 5, wherein said lower thickness is larger than the upper thickness.

7. The crowbar of claim 3, wherein the tip portion and the slot are symmetrically about the bearing surface axis.

8. The crowbar of claim 3, wherein the tip portion is a flared tip portion.

9. The crowbar of claim 5, wherein said upper portion having a straight portion has a transverse thickness which is about equal to the lower thickness.

10. The crowbar of claim 4, wherein the upper portion having a pointed end portion has a tapered thickness and has a flared tip portion.

* * * * *